United States Patent [19]

Moye

[11] 4,112,573

[45] Sep. 12, 1978

[54] METHOD OF FORMING AN ANIMAL-FIGURE DECORATION

[76] Inventor: Helen Ione Moye, P.O. Box 53, Wharton, N.J. 07885

[21] Appl. No.: 835,433

[22] Filed: Sep. 21, 1977

[51] Int. Cl.[2] ..... B21F 45/00

[52] U.S. Cl. ..... 29/428; 140/71 R

[58] Field of Search ..... 29/428, 400 M; 140/71 R, 102; 46/115, 123, 151, 158; D11/137, 162; D34/2 R, 2 A, 2 C, 15 B

[56] References Cited

U.S. PATENT DOCUMENTS

| | | | |
|---|---|---|---|
| 2,044,949 | 6/1936 | Levy et al. | D34/2 R |
| 2,474,236 | 6/1949 | Durbin | 46/151 |
| 2,812,616 | 11/1957 | Ford | 46/151 |

*Primary Examiner*—Michael J. Keenan
*Attorney, Agent, or Firm*—Thomas N. Neiman

[57] ABSTRACT

The invention comprises an improved method of forming an animal-figure decoration, such as a swan or the like, from fabric. A support frame, in the form of a wire rod, receives enveloping annuli of ruches of fabric, in predetermined positionings. The ruche annuli are formed of fabric of common-length strips and both discrete and common widths. The widths of the strips — from which the annuli are formed — determine the positionings thereof on the wire rod, and result in the definition of an animal figure of optimum shape.

10 Claims, 7 Drawing Figures

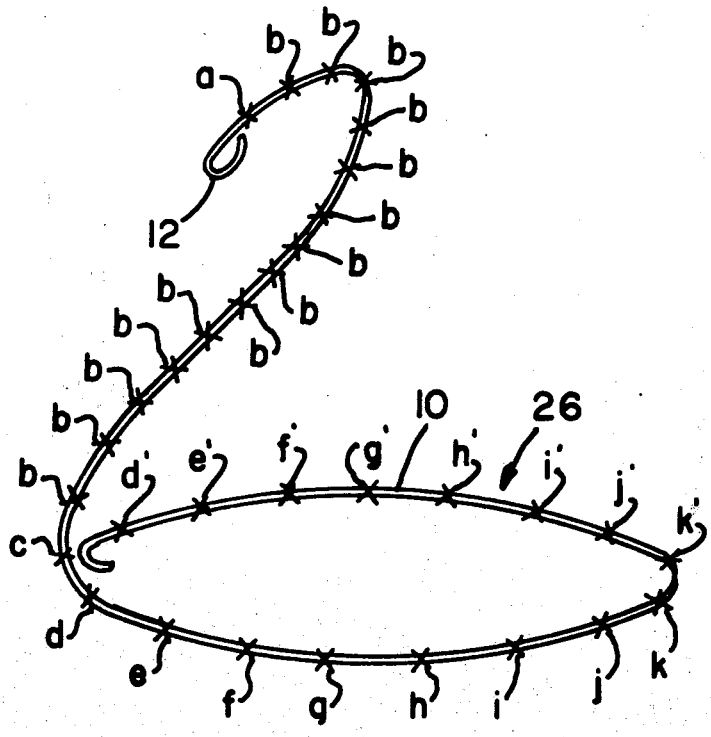

PROVIDING A LENGTH OF WIRE ROD

FORMING A SMALL LOOP AT ONE END OF SAID ROD

FORMING RUCHES OF FABRIC STRIPS OF COMMON AND DISCRETE WIDTHS

FORMING ANNULI OF SAID RUCHES

ENVELOPING SAID ROD WITH SAID ANNULI IN JUXTA POSITON WITH ANNULI OF COMMON AND DISCRETE WIDTH FABRIC STRIPS IN PREDETERMINED POSITIONINGS THEREALONG

BENDING A PORTION OF SAID ROD TO DEFINE THE BODY OF AN ANIMAL FIGURE

BENDING A PORTION OF SAID ROD TO DEFINE THE NECK OF AN ANIMAL FIGURE

AND BENDING AN END OF SAID ROD TO DEFINE THE HEAD OF AN ANIMAL FIGURE

FIG. 1

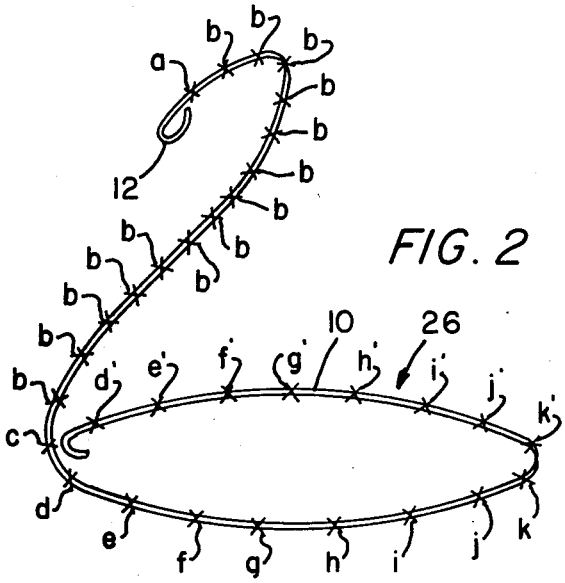

FIG. 2

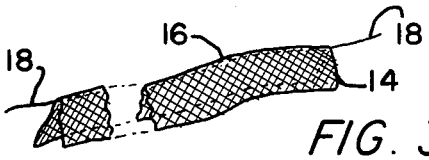

FIG. 3

FIG. 5

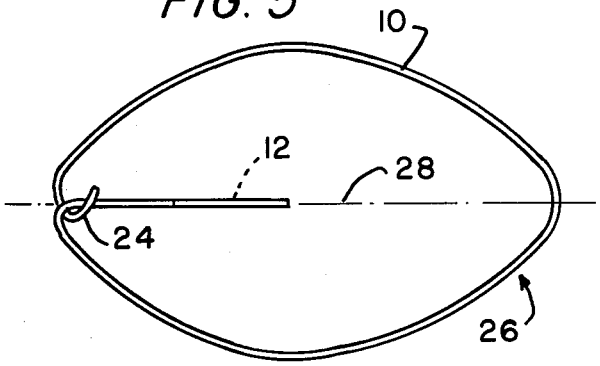

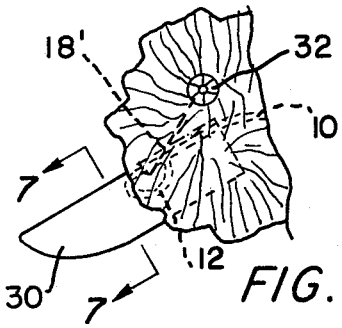

FIG. 6

FIG. 7

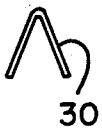

FIG. 4

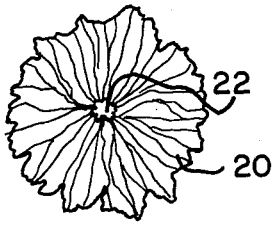

METHOD OF FORMING AN ANIMAL-FIGURE DECORATION

This invention pertains to decorative fabric articles, and in particular concerns methods of forming animal-figure decorative articles from fabric.

Methods of forming animal-figure decorative articles which are known usually comprise the emplacement of uniform pieces of fabric on a plurality of wire rods, and then bunching the fabric-covered rods, as necessary, to define a broad cross-section of figure as a "body", and employing a single fabric-covered rod as a "neck", and building the animal-figure in this manner. Alternatively, animal-figure fabric articles have been formed with a fabric-covered rod having short-radius fabric at one end of the rod — again, to define a "neck" (or "limbs") and long-radius fabric along the other end of the rod to define a "body" and, thus, the rod makes a single run-through in the figure. The former method is not satisfactory as it requires the splicing or entwining of the several "bunched" rods; this is a complex and expensive process to employ in manufacture, and it does not yield up an attractive end product. The latter method is unsatisfactory in that the long-radius fabric is given to rotating about the single run-through rod whereupon the figure soon becomes deformed and misshapened. Too, the "body" enclosed terminal end of the rod, with use of the article, proceeds to tear out portions of the fabric and, more importantly, subsequently becomes exposed and presents itself as a danger which damages furniture and harms persons.

It is an object of this invention to set forth an improved method of forming an animal-figure decoration which avoids the afore-mentioned disadvantages of the known methods. It is an object to set forth a method of forming an animal-figure decoration which yields a safe product which is singularly attractive. Particularly, it is an object of this invention to disclose an improved method of forming an animal-figure decoration, such as a swan or the like, comprising the steps of providing a length of compliant wire rod; forming a small loop at one end of said rod; forming a plurality of ruches; and forming annuli of said ruches; wherein said ruches-plurality-forming step comprises forming said ruches of fabric strips of both discrete and common widths; and further including enveloping said rod with said annuli in juxtaposition therealong; and wherein said enveloping step comprises disposing said annuli in envelopment of said rod with (a) a first annular ruche formed of a first width disposed adjacent to said small loop, (b) with a first plurality of second annular ruches all of which are formed of a second, common width disposed adjacent to said first annular ruche, (c) with a third annular ruche formed of a third width disposed adjacent to said first plurality of ruches, (d) with a second plurality of annular ruches formed of progressively increasing widths disposed adjacent to said third annular ruche, (e) with a third plurality of annular ruches formed of progressively increasing widths disposed adjacent to said second plurality of ruches, (f) with a fourth plurality of annular ruches formed of progressively diminishing widths disposed adjacent to said third plurality of ruches, and (g) with a fifth plurality of annular ruches formed of progressively diminishing widths disposed adjacent to said fourth plurality of ruches; bending said rod to define a substantially elliptical and uniplanar loop of said second, third, fourth, and fifth pluralities of ruches; bending said rod whereat said third annular ruche is disposed to dispose said first plurality of annular ruches substantially diagonal to, and partially overlying said elliptical loop, in a plane normal to said elliptical loop; and bending said one end of said rod into a substantially U-shaped configuration, in said normal plane, with the terminal end of said rod disposed outward relative to said elliptical loop.

Further objects of this invention, as well as the novel features thereof, will become more apparent by reference to the following description taken in conjunction with the accompanying figures, in which:

FIG. 1 is a block diagram of the basic process steps of the inventive method;

FIG. 2 is an isometric view of the wire rod as substantially finally shaped, without the enveloping fabric being shown, but with superimposed X's denoting the positionings of the annular ruches;

FIG. 3 is a discontinuous, isometric view of a piece of fabric shown threaded and ready to be formed into an annular ruche;

FIG. 4 is a plan view of an annular ruche;

FIG. 5 is a plan view of the finally formed rod — without the annular ruches thereon;

FIG. 6 is a fragmentary view of the "head" portion of the completed animal figure showing the manner of fixing the beak and eyes in place; and FIG. 7 is a cross-sectional view of the beak, taken along section 7—7 of FIG. 6.

As exemplified by the block diagram of FIG. 1, and the illustrations of FIGS. 2–6, the novel method of my invention comprises providing a length of compliant wire rod 10 which, for example, is approximately 36 to 42 inches in length. A wire coat hanger is quite suitable for the purpose. A small loop 12 is formed in one end of the rod 10, and the fabric is emplaced on the rod 10 commencing with a first positioning in adjacency to the small loop 12.

A preferred fabric is netting, however the invention is not limited to this or any particular fabric. For the want of a better word, the rod-enveloping fabric elements are referred to as ruches (also spelled rouches), in that they comprise multi-fold strips of netting; i.e., they have tight ruffles radiating from a tautly drawn thread. Hence, each is gathered at one side by the thread, and has open folds opening outwardly from the thread.

According to this embodiment of the invention, 32 ruches are formed for envelopment of the rod 10. Each is formed from netting having a 2 yard length, and in the following widths: one — 2½ inches, fourteen — 2 inches, one — 3 inches, two — 3½ inches, two — 5 inches, four — 6 inches, two — 8 inches, two — 10 inches, two — 12 inches, and two — 14 inches.

Each of the above-described pieces or strips of netting is folded lengthwise; FIG. 3 shows the netting strip 14 for a ruche, the strip being discontinuous, with the proper fold 16 made therein. A running stitch is made in the folded strip 14, with button or rug thread 18, as close to the fold 16 as possible. Next each such stitched strip 14 is "gathered" by tying the ends of the thread 18 together tightly. Accordingly, a pom-pom or annular ruche is the result. One of such is shown in FIG. 4 by index number 20.

The annular ruches 20 are emplaced on the wire rod 10 in a predetermined sequence or positionings, and the latter are indicated in FIG. 2 by the superimposed X's. The two and a half inch wide ruche 20 is slid on the rod 10, by means of the central void 22 in the ruche, into position next to the small loop 12; this positioning is shown by the first X "*a*". The ruches 20 formed of the two inch wide netting, all fourteen of them, are next set onto the rod in the positionings represented by the X's "*b*". In following sequence, the three inch-wide material ruche is to be slid onto the rod 10 (where it assumes a positioning at the base of the "neck" section, then, the 3½ inch-wide material ruche, one of the 5 inch ruches, two of the 6 inch ruches, one of the 8 inch ruches, one of the 10 inch ruches, one of the 12 inch ruches and one of the 14 inch ruches are slid onto the rod — to assume the positionings represented by the X's "*c*", "*d*", "*e*", "*f*", "*g*", "*h*", "*i*", "*j*", and "*k*", respectively. It is to be noted that, in this, positionings "*f*" and "*g*" are both occupied with ruches 20 formed of the 6 inch wide netting. Finally, and again in sequence, the other 14 inch ruche, the other 12 inch ruche, the other 10 inch ruche, the other 8 inch ruche, the remaining two 6 inch ruches, the other 5 inch ruche, and the other 3½ inch ruche, are slid onto the rod 10, to take up positionings at the X's (FIG. 2) which carry the indexes "*k*'", "*j*'", "*i*'", "*h*'", "*g*'", "*f*'", "*e*'", and "*d*'". The ruche positionings "*d*" through "*k*" have their counterparts in like-indexed positionings which, however, carry prime (') marks; this is done only to more readily denote that the like-indexed positionings all receive ruches of netting fabric formed of like widths. To wit: positionings "*i*" and "*i*'" each receive the 10 inch wide netting ruches 20, and positionings "*f*" and "*f*'" the one pair (of two) of 6 inch wide netting ruches 20, and so on. ;p Upon all the pom-poms or ruches 20 having been properly positioned on the rod 10, then the end of the rod which is opposite the small loop 12 is bent to define a hook 24. The rod is also bent to define a generally elliptical loop 26 of the portion thereof which has positionings "*d*" through "*d*'" thereon. Upon this having been done, the hook 24 is put into engagement with an intermediate portion of the rod 10 adjacent to positioning "*c*", and the rod portion which extends therefrom to loop 12 is also bent. This latter portion is bent into a generally diagonal disposition rising in a plane 28 which is normal or perpendicular to the plane in which the elliptical loop 26 subsists. Thus, all the positionings "*b*", and positioning "*a*", and the rod portion thereof, partially overlie the elliptical loop 26. Approximately where the third positioning "*b*", outward from positioning "*a*", is located, the small loop bearing end of the rod 10 is bent again into a general U-shape. The U-shape bend is made to dispose the end of the rod 10 generally parallel with the adjacent portion thereof, but is disposed outward of the elliptical loop 26 albeit in the same normal plane 28.

In accordance with the foregoing procedural steps, the forming of the elliptical loop 26 defines the body of a swan, the elevation and inclination of the remaining portion of the rod 10 defines the neck of a swan, and finally, the U-shape bending of the end of the rod 10 which carries the small loop 12 defines the head of the swan. It is to be noted that the "body" of the swan confines the hook 24 end thereof therewithin, and there is no dangerous or injurious rod end at the rear of the swan "body". Too, the body is formed of two lengths of rod 10 — which two define the elliptical loop 26, thus the netting material is prevented from "rotating"; rather the netting material of the body assumes a wide "stance". The other end of the rod 10, also, is disposed of in a manner which will avoid its doing any injury or damage; the small loop 12 tucks the sharp end of rod 10 in and under the adjacent portion of the rod. More, the small loop 12 presents itself as an excellent support for a beak 30 (FIG. 6). To give the decorative swan the finishing touches, the beak 30, comprising a bent piece of properly shaped card-board material, is fixed to the small loop 12 with thread — such as thread 18 as was used in forming the ruches. The beak is positioned on the small loop 12, with the base of the beak pressed into the ruche 20 occupying positioning "*a*", and the thread 18' passed across the top of the beak and through the small loop 12. Next, the thread 18' is passed through the netting of ruche 20 in positioning "*a*" to emerge out one side thereof and to receive and fix thereto an "eye" 32. Finally, the thread 18' is passed through the same ruche 20, to emerge out the other side thereof, to fix a companion "eye" 32 in place. The thread 18' is tied off under the beak 30, or knotted and severed within one of the folds of the same foremost ruche 20.

While I have described my invention in connection with a specific embodiment, and a particular process of making the same, it is to be clearly understood that this is done only by way of example and not as a limitation to the scope of my invention as set forth in the objects thereof and in the appended claims. For instance, I set out a rod 10 of approximate lengths, and ruches of certain numbers and formed of netting of prescribed length and widths. This is only exemplary as, clearly, it will be desired to make an animal figure, as swan or the like, in different sizes. Thus, the rod length will vary, as will the numbers and "cut" of the fabric strips 14, in forming a larger, or a smaller figure. It is self-evident, of course, that netting of different colors may be used, to simulate a "mask" across the top of the beak 30, or to make a figure of any chosen hue. Any such refinements or modifications patently proceed from my teaching herein, and are within the ambit of my invention.

I claim:

1. A method of forming an animal-figure decoration, such as a swan or the like, comprising the steps of:

providing a length of compliant wire rod;

forming a small loop at one end of said rod;

forming a plurality of ruches; and forming annuli of said ruches; wherein said ruches-plurality-forming step comprises forming said ruches of fabric strips of both discrete and common widths; and further including enveloping said rod with said annuli in juxtaposition therealong; and wherein said enveloping step comprises disposing said annuli in envelopment of said rod with (a) a first annular ruche formed of a first width disposed adjacent to said loop, (b) with a first plurality of second annular ruches all of which are formed of a second, common width disposed adjacent to said first annular ruche, (c) with a third annular ruche formed of a third width disposed adjacent to said first plurality of ruches, (d) with a second plurality of annular ruches formed of progressively increasing widths disposed adjacent to said third annular ruche, (e) with a third plurality of annular ruches formed of progressively increasing widths disposed adjacent to said second plurality of ruches, (f) with a fourth plurality of annular ruches formed of progressively diminishing widths disposed adjacent to said third plurality of ruches, and (g) with a fifth plurality of annular ruches formed of progressively diminishing widths disposed adjacent to said fourth plurality of of ruches;

bending said rod to define a substantially elliptical and uniplanar loop of said second, third, fourth and fifth plurality of ruches;

bending said wire rod whereat said third annular ruche is disposed to dispose said first plurality of annular ruches substantially diagonal to, and partially overlying said elliptical loop, in a plane normal to said elliptical loop; and bending said one end of said rod into a substantially U-shaped configuration, in said normal plane, with the terminal end of said rod disposed outward relative to said elliptical loop.

2. A method of forming an animal-figure decoration, according to claim 1, wherein:

said ruches-plurality-forming step further comprises forming said second annular ruches of fabric strips having a width which is less than the width of fabric strip from which said first annular ruche is formed, and forming said third annular ruche of a strip of fabric having a width which is greater than the width of fabric strip from which said first annular ruche is formed.

3. A method of forming an animal-figure decoration, according to claim 1, wherein:

said ruches-plurality-forming step further comprises forming each of said second and third pluralities of annular ruches with at least one annular ruche formed of a same width fabric strip.

4. A method of forming an animal-figure decoration, according to claim 1, wherein:

said ruches-plurality-forming step further comprises forming said second and fifth pluralities of annular ruches each with annular ruches of a same quantity and each with annular ruches formed of common width fabric strips.

5. A method of forming an animal-figure decoration, according to claim 1, wherein:

said ruches-plurality-forming step further comprises forming said third and fourth pluralities of annular ruches each with annular ruches of a same quantity and each with annular ruches formed of common width fabric strips.

6. A method of forming an animal-figure decoration, according to claim 1, wherein:

said ruches-plurality-forming step further comprises forming said third and fourth pluralities of annular ruches each with an annular ruche formed of a common width fabric strip; and said enveloping step comprises disposing said annular ruches of common width fabric strips of said third and fourth pluralities in juxtaposition.

7. A method of forming an animal-figure decoration, according to claim 1, wherein:

said ruches-plurality-forming step further comprises forming all said ruches of fabric strips of one common length.

8. A method of forming an animal-figure decoration, according to claim 7, wherein:

said ruches-plurality-forming and annuli-forming steps comprise folding each of said fabric strips, lengthwise, along the center thereof, sewing a running stitch therein in immediate proximity to the center fold thereof with the running-stitch thread extending from each end of said strip, gathering each stitched strip by moving the ends thereof along the stitch thread toward the center of the length thereof, and tying together the ends of said stitch thread to define an annulus having a central void and radially disposed folds of fabric.

9. A method of forming an animal-figure decoration, according to claim 8, wherein:

said rod-enveloping step comprises enveloping said rod with said radially disposed folds by moving said rod through said void.

10. A method of forming an animal-figure decoration, according to claim 1, further including:

fixing a simulation of an animal beak to said small loop.

* * * * *